United States Patent [19]

Kaminkow

[11] Patent Number: 5,048,832

[45] Date of Patent: Sep. 17, 1991

[54] DOUBLE BALL LAUNCHER FOR ROLLING BALL GAME

[75] Inventor: Joseph E. Kaminkow, Arlington Heights, Ill.

[73] Assignee: Data East Pinball, Inc., Melrose Park, Ill.

[21] Appl. No.: 656,584

[22] Filed: Feb. 19, 1991

[51] Int. Cl.[5] ..... A63F 7/26

[52] U.S. Cl. ..... 273/129 V; 273/129 R; 273/129 S; 273/119 R; 273/119 A; 273/120 R; 273/120 A

[58] Field of Search .....: 273/128, 118 R, 118 A, 273/119 R, 119 A, 119 B, 120 R, 120 A, 121 R, 121 A, 121 B, 122 R, 122 A, 123 R, 123 A, 124 R, 124 A, 125 R, 125 A, 129 R, 129 S, 129 T, 129 V, 129 W

[56] References Cited

U.S. PATENT DOCUMENTS

| | | | |
|---|---|---|---|
| 2,610,059 | 9/1952 | Koci | 273/124 A |
| 3,870,307 | 3/1975 | Meyer et al. | 273/129 S |
| 3,901,511 | 8/1975 | Garbark | 273/123 A |
| 4,203,602 | 5/1980 | Kral | 273/121 A |

*Primary Examiner*—Edward M. Coven
*Assistant Examiner*—Raleigh W. Chiu
*Attorney, Agent, or Firm*—Gerstman & Ellis, Ltd.

[57] ABSTRACT

A rolling ball game such as pinball comprises a playfield plus means for launching rolling balls onto the playfield. By this invention, the launching means comprises a station where a ball at rest is positioned for said launching, spring-operated manual plunger means for launching the ball from the station, and an electrically operated arm for launching the ball from the same station. Thus, the same ball can be launched by two alternative means, one of which is manually controlled, but the other of which can be automatically controlled in response to events of the game.

10 Claims, 1 Drawing Sheet

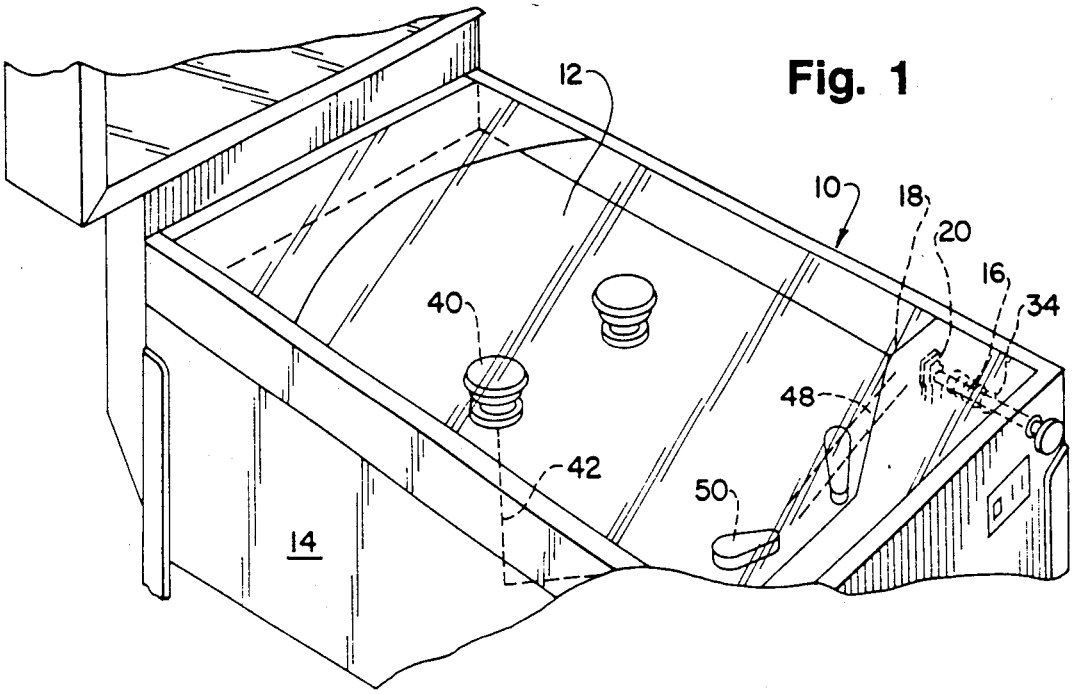
Fig. 1
Fig. 2
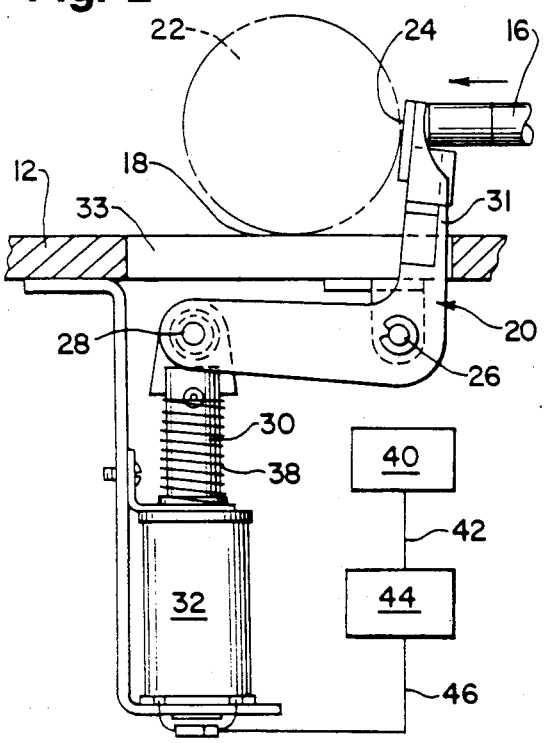
Fig. 3
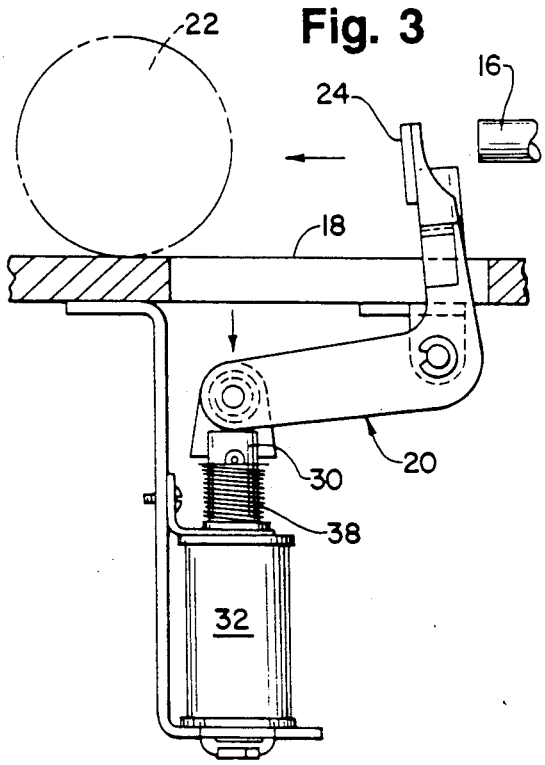

DOUBLE BALL LAUNCHER FOR ROLLING BALL GAME

BACKGROUND OF THE INVENTION

In pinball games, a ball is launched, typically by a spring-operated plunger, onto a playfield about which the ball rolls to strike targets and the like.

A search is always on for new features and actions in pinball or another rolling ball game, so that the interest of the players remains high. While it is of course conventional to launch the ball with a spring-operated plunger, on occasions, pinball games have been provided in which an automatic launcher system is provided, for example, the Centaur brand pinball game. In such a complex system, the ball is launched automatically in a different ball launching path, while also a manual ball launching system and launching path exists, being a different path from the automatic launching system.

Additionally, powered manual launching exists in various pinball games, where the ball is launched in electrically operated games by the press of a button.

In this invention, a rolling ball game is provided in which balls can either be manually or electrically launched from the same ball launching stations, with a simplification of design and a saving of space. This provides a situation where the user may launch a ball at any time, but also the electrically operated system may launch the same ball at any time. Thus a certain measure of competition may take place between the user of the game and a program in the game which automatically launches balls at predetermined times, which may be unknown to the player.

In this invention, a rolling ball game is provided which comprises a playfield plus means for launching rolling balls onto the playfield. In accordance with the invention, means are provided comprising a station where the ball at rest is positioned for launching. Spring-operated, manual plunger means are provided for launching the ball from the station. Additionally, an electrically operated arm is provided for launching the same ball from the same station.

The arm is preferably positioned between a ball at the station and the plunger means, so that the plunger means has to strike and push the arm in order to launch the ball. The arm is pivotally movable to launch the ball, with the power source used to pivotally move the arm being either the plunger means or electrical means for pivoting the arm to launch the ball. The electrical means may for example be a solenoid or any other desired electrical power means, including electrically operated pneumatic means or the like.

Additionally, control means are preferably provided for actuating the electrical means for pivoting the arm and launching a ball in a manner responsive to events of the game. This may simply be a random actuation of the electrical means responsive to initiation of the game, or a series of timed actuations from the beginning of the game or some other event therein, or the like. The electrical means may be actuated by events during the game, for example when a certain target on the playfield is struck, or the like. There is no limitation as to the specific features of the program for when the electrical means for pivoting the arm shall be actuated in the game. Thus, the effect is that the user is frequently surprised by the unexpected launching of balls onto the playfield by the game itself. This adds an added dimension of action and difficulty to the game, to stimulate increased interest by the user.

Also, it is preferred for means for automatically loading balls to the station to be provided. Such means per se are conventional, and are found in other pinball machines. Thus, the player of a game in accordance with this invention may suddenly find himself faced with a playfield full of rolling balls, provided by the automatic ball feeder and the electrical means for actuating the launching arm, as dictated by a control means program which may be present in a microprocessor of the rolling ball game.

DESCRIPTION OF DRAWINGS

FIG. 1 is a fragmentary perspective view of a pinball machine in accordance with this invention;

FIG. 2 is a fragmentary, elevational view, showing a portion of the spring-operated manual plunger means for launching and also showing the electrically operated arm and some of its powered system for actuation in a first position of operation; and FIG. 3 is a fragmentary, elevational view of a portion of the system of FIG. 2 shown in a different mode of operation.

DESCRIPTION OF SPECIFIC EMBODIMENT

Referring to the drawings, pinball machine 10 comprises a playfield 12 which is carried by cabinet 14 in the usual manner of pinball machines. The pinball machine of this invention may be conventional except as otherwise described herein. A spring-operated, manual plunger 16 is shown, for launching pinballs from ball launching station 18, in a manner which is generally conventional.

However, in accordance with this invention, an added, pivotable arm 20 is provided, positioned between spring plunger 16 and a ball 22 which is positioned at launching station 18. Launching arm 20 defines a ball contacting pad 24, with arm 20 being mounted at pivot 26 to the underside of playfield 12.

As shown in FIGS. 2 and 3, ball launching arm 20 is of L-shaped configuration, and is pivotally connected at end 28 to the actuating arm 30 of a solenoid. Section 31 of arm 20 projects through slot 33 defined in playfield 12, which slot is too narrow for ball 22 to fall through. Thus, as shown in FIG. 3, when solenoid 32 is actuated, arm 20 is vigorously rotated counterclockwise by a short distance, to launch ball 22 from launching station 18 onto the playfield.

As another, alternative operation, solenoid 32 does not have to be actuated, but, instead, manual plunger 16 is drawn back and released, driven by spring 34 to impact launching arm 20. This also causes its rapid counterclockwise rotation for a short distance, powered by this different means. The results are substantially the same, in that ball 22 is launched from launching site 18 onto the playfield 12 with either mode of operation. Even when not powered, the actuating shaft 30 of solenoid 32 still is capable of reciprocating back and forth, being urged outwardly by spring 38, so that launching arm 20 normally assumes the position of FIG. 2.

When a ball 22 strikes a target 40 or the like, an electrical signal may be sent through wire 42 to microprocessor 44. In response to this signal, as dictated by the instructions which may be stored for example, in a RAM of microprocessor 44, an actuating signal may be sent from microprocessor 44 to wire 46 to actuate solenoid 32.

Accordingly, by way of example, solenoid 32 may be actuated immediately when a ball strikes a desired target 40. Otherwise, if desired, a timer may be actuated by such an event to actuate solenoid 32 after a predetermined time beginning with the event. Any event whatsoever may serve as the basis for actuation of solenoid 32, with timing or not as may be desired. Likewise, when the pinball machine 10 is actuated for play, signals may be sent through wire 46 from microprocessor 44 in a randomized manner responsive to the initiation of play, if that is desired, without limitation of the specific nature or pattern of the actuation of solenoid 32 to, in turn, actuate launching of balls by arm 20.

A conventional ball feeding apparatus 48 may be provided to automatically load balls to station 18. Thus, during the playing of the game, a ball 22 may be launched at any time as dictated by the microprocessor 44. Additionally, the user may launch the same ball at any time by the use of manual plunger 16. Accordingly, an interactive game with added levels of difficulty may be provided as the user attempts to outguess the machine as to the time of ball launching, and as the player attempts to maximize his chances of a high score by judicious ball launching in competition with that of the machine.

The pinball game of this invention may carry conventional flippers 50 and the many other features that make a game exciting and worthy of skilled play.

The above has been offered for illustrative purposes only, and is not intended to limit the scope of this application, which is as defined in the claims below.

That which is claimed is:

1. In a rolling ball game which comprises a playfield and means for launching rolling balls onto the playfield, the improvement comprising, in combination:

said means comprising a station where a ball at rest is positioned for said launching, spring-operated, manual plunger means for launching said ball from the station, and an electrically operated arm for launching said ball from the same station.

2. The rolling ball game of claim 1 in which said arm is positioned between a ball at said station and said plunger means, said arm being pivotally movable to launch said ball, alternatively powered either by said plunger means or by electrical means for pivoting said arm to launch said ball.

3. The rolling ball game of claim 2 in which said electrical means comprises a solenoid.

4. The rolling ball game of claim 2 including means for actuating said electrical means for pivoting said arm in a manner responsive to events of said game.

5. The rolling ball game of claim 4 including means for automatically loading balls to said station.

6. The rolling ball game of claim 2 including mean for automatically loading balls to said station.

7. The rolling ball game of claim 2 in which said arm is L-shaped.

8. In a rolling ball game which comprises a playfield and means for launching balls onto the playfield, the improvement comprising, in combination:

said means comprising a station where a ball at rest is positioned for said launching, spring-operated manual plunger means for launching said ball from the station, and an electrically operated arm for launching said ball from the said station, in which said arm is positioned between a ball at said station and said plunger means, said arm being pivotally movable to launch said ball, said arm being alternatively powered either by said plunger means or by a solenoid connected for pivoting said arm to launch said ball, and further including means for actuating said solenoid for pivoting said arm in a manner responsive to events of said game.

9. The rolling ball game of claim 8 including means for automatically loading the balls to said station.

10. The rolling ball game of claim 9 in which said arm is L-shaped.

* * * * *